US006659889B2

(12) United States Patent
Kasashima et al.

(10) Patent No.: US 6,659,889 B2
(45) Date of Patent: Dec. 9, 2003

(54) GOLF BALL

(75) Inventors: Atsuki Kasashima, Chichibu (JP); Junji Umezawa, Chichibu (JP); Hideo Watanabe, Chichibu (JP); Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/201,290

(22) Filed: Jul. 24, 2002

(65) Prior Publication Data

US 2003/0032504 A1 Feb. 13, 2003

(30) Foreign Application Priority Data

Jul. 27, 2001 (JP) ..... 2001-227864

(51) Int. Cl.[7] ..... A63B 37/12
(52) U.S. Cl. ..... 473/374; 473/373; 473/384
(58) Field of Search ..... 473/371, 373, 473/374, 378, 379, 380, 381, 383

(56) References Cited

U.S. PATENT DOCUMENTS

| | | | | | |
|---|---|---|---|---|---|
| 5,078,402 | A | * | 1/1992 | Oka | 40/327 |
| 5,145,180 | A | * | 9/1992 | Oka | 40/327 |
| 5,779,563 | A | | 7/1998 | Yamagishi et al. | |
| 5,782,707 | A | | 7/1998 | Yamagishi et al. | |
| 5,876,294 | A | | 3/1999 | Yamagishi et al. | |
| 6,204,333 | B1 | * | 3/2001 | Higuchi et al. | 525/221 |
| 6,413,171 | B1 | * | 7/2002 | Shimosaka | 473/378 |
| 6,508,723 | B1 | * | 1/2003 | Shimosaka | 473/351 |

* cited by examiner

*Primary Examiner*—Paul T. Sewell
*Assistant Examiner*—Thanh P Duong
(74) *Attorney, Agent, or Firm*—Sughrue Mion, PLLC

(57) ABSTRACT

A golf ball comprising an elastic solid core, an intermediate layer and a resin cover of urethane elastomer having a plurality of dimples on its surface, wherein the dimples include 330–400 circular dimples having a diameter of 3.7–5.0 mm, have a total volume of 330–380 mm$^3$, and are substantially uniformly distributed such that there is no or only one great circle which does not intersect with the dimples exhibit uniform flight performance.

7 Claims, 1 Drawing Sheet

GOLF BALL

This invention relates to a multi-piece solid golf ball comprising an elastic solid core enclosed with a resin cover of two different hardness layers and exhibiting uniform flight performance.

BACKGROUND OF THE INVENTION

The golf balls are now under a rapid transition from the thread wound structure to the solid structure because most golfers favor the superior distance performance of solid balls.

The solid structure is initially typified by two-piece solid golf balls in which a solid core of rubber having excellent resilience is disposed at the center of the ball as the majority thereof and enclosed with a hard resin cover formed of ionomer resins or the like for providing protection against external damages.

Although the solid ball is good in distance, it undergoes a smaller deformation upon impact than the wound golf ball. The solid ball then gives a hard or unpleasant feel when hit. Since the smaller deformation corresponds to a smaller area of contact with the club face, the solid ball receives less spin and is thus less controllable on use of an iron club.

Many attempts were made to overcome these drawbacks, for example, by reducing the hardness of the solid core, placing a buffer layer between the core and the cover, and using relatively flexible polyurethane as the cover stock.

As a consequence, the feel and spin rate are improved to a substantially satisfactory level. However, the same attempts for such improvement raise new undesirable issues. Due to a decline of rebound, the distance characteristic of the solid structure is rather reduced. When hit with a wood club, especially a driver intended for distance, the ball receives more spin so that the ball may rather sky, thus traveling a shorter distance. No substantial progress has been marked in solving the above problems.

SUMMARY OF THE INVENTION

An object of the present invention is to provide a golf ball comprising a solid core and a plurality of enclosing layers in which the combination of materials of the enclosing layers and the configuration and arrangement of dimples on the outermost enclosing layer or cover are adjusted such that the ball is given both the performances that the ball, when hit with a driver or similar club having a high head speed, may travel a distance while suppressing the reception of excessive spin, and when hit with a short iron or similar club having a large loft angle, may receive a high spin rate, which have been allegedly difficult to achieve both at the same time.

The present invention provides a golf ball comprising an elastic solid core, an intermediate layer around the core, and a resin cover around the intermediate layer, composed mainly of a urethane elastomer and having a plurality of dimples on its surface. The dimples include 330 to 400 circular dimples having a diameter of at least 3.7 mm, have a total volume of 330 to 380 $mm^3$, and are substantially uniformly distributed such that there is no or only one great circle which does not intersect with the dimples. Owing to the optimized shape and arrangement of dimples combined with the inherent advantages of multi-piece solid golf balls, the golf ball has improved travel distance performance and uniform flight performance to ensure a high spin rate on short iron shots.

In a preferred embodiment, SP is in the range of 80 to 94, provided that a sphere consisting of the core and the intermediate layer undergoes a distortion A when the load applied thereto is increased from 98 N (10 kgf) to 1275 N (130 kgf), the intermediate layer has a Shore D hardness B, the cover has a Shore D hardness C and a gage D, and SP is defined as a function of A, B, C and D by the following equation: $SP=C+0.5B-5D+5A$.

Also preferably, the dimples account for at least 78% of the outer surface area of the ball.

DESCRIPTION OF THE PREFERRED EMBODIMENTS

It is noted that the term "radial" as used herein is a radial direction extending from the center of the ball. When a preferred range, such as 5 to 25, is given, this means preferably not less than 5, and separately and independently, preferably not more than 25.

Figure 1:
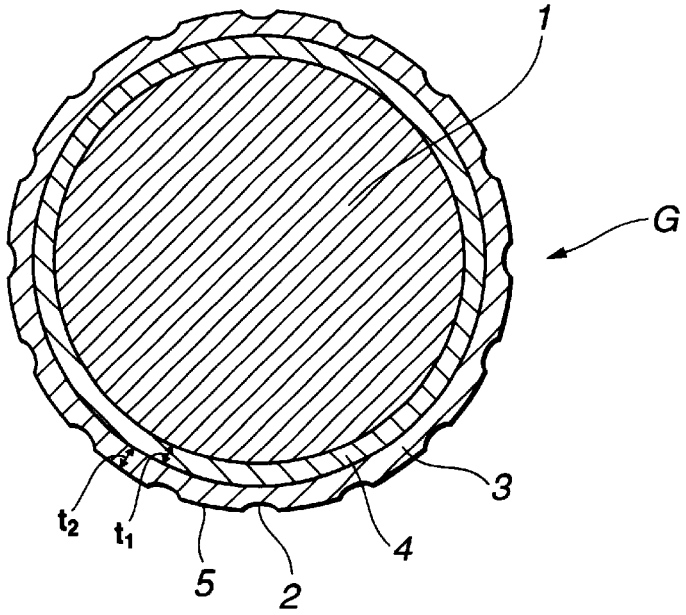
FIG. 1 is a schematic cross-sectional view of a golf ball according to the invention.

Referring to FIG. 1, the golf ball of the invention is a multi-piece solid golf ball G comprising an elastic solid core 1 which is concentrically enclosed with a resin layer including an intermediate layer 4 and a cover 3 having a plurality of dimples 2 on its surface. The intermediate layer 4 is disposed between the core 1 and the cover 3. The surface of the cover 3 where no dimples are formed is known as land 5.

The elastic solid core is made of any well-known material, preferably a rubber composition. The preferred rubber composition uses polybutadiene as the base rubber. The preferred polybutadiene is cis-1,4-polybutadiene containing at least 40% by weight of cis structure. In the base rubber, natural rubber, polyisoprene rubber or styrene-butadiene rubber may be blended with the polybutadiene, if desired. Increasing the rubber component is effective for improving the rebound of the resulting golf ball. In addition to the base rubber, the rubber composition may contain other ingredients well-known for core materials, for example, unsaturated carboxylic acids and/or metal salts thereof, organic peroxides, and organic sulfur compounds.

The elastic solid core may be prepared by molding, vulcanizing and curing the rubber composition in a well-known manner.

The elastic solid core generally has a diameter of at least 35.6 mm, preferably at least 36.0 mm, more preferably at least 36.2 mm and up to 39.0 mm, preferably up to 38.0 mm, more preferably up to 37.0 mm. This diameter range is recommended to ensure improved flight performance.

The elastic solid core is enclosed with the intermediate layer which is formed from any well-known resin material, preferably an ionomer resin composition, by a conventional method.

The intermediate layer has a gage or radial thickness (mm) designated "$t_1$" in FIG. 1. It is recommended that the gage $t_1$ be in the range of 1.0 mm to 2.0 mm. Desirably the gage $t_1$ is equal to or slightly greater than the gage $t_2$ of the cover to be described later.

The intermediate layer should have a surface Shore D hardness of at least 58, preferably at least 60 and up to 68, preferably up to 66. It is noted that the surface Shore D hardness is a hardness measured at the surface of a sphere, and this terminology is equally applicable to the intermediate layer and the cover. If the intermediate layer is too soft, the ball may receive more spin on any shot, which leads to a shorter travel distance, and give a too soft feel. Too hard an intermediate layer may lead to a less spin rate, control difficulty, a hard feel, and poor anti-cracking durability upon repetitive shots.

The intermediate layer is enclosed with the cover which is composed mainly of a urethane elastomer. The urethane elastomer may be either a thermoplastic or thermosetting polyurethane elastomer. The cover can be formed by a conventional method.

The cover 3 has a gage or radial thickness between the outer surface of the intermediate layer 4 and the outer surface of the cover 3 where no dimples are formed, that is, land 5 and designated at "$t_2$" in FIG. 1. It is recommended that the cover gage $t_2$ be in the range of 0.7 mm to 1.7 mm.

The cover should have a surface Shore D hardness of at least 45, preferably at least 47 and up to 56. It is recommended that the Shore D hardness of the cover be lower than that of the intermediate layer. If the cover is too soft, a more spin rate on every shot may result in a decline of distance and the feel may become too soft. If the cover is too hard, a less spin rate may result in difficulty to control and the feel may become harder.

While it is already recommended that the surface hardness of the cover be lower (or softer) than that of the intermediate layer, it is further recommended that the difference in Shore D hardness between the intermediate layer and the cover be at least 5 units, especially at least 10 units and up to 20 units, especially 15 units. Too much a hardness difference may adversely affect durability.

The golf ball of the invention has on the cover surface a plurality of dimples which should be optimized according to the invention. Referring to FIG. 1 again, the dimples 2 include dimples of plural types which differ in diameter and/or depth. Inclusion of dimples of two or more types is satisfactory to the purpose of the invention. The shape of dimples is not critical although they are often circular as viewed in a plane (orthogonal to a radial direction). It is recommended that dimples which are circular in planar shape have a diameter of at least 2.0 mm, especially at least 2.5 and up to 5.0 mm, especially up to 4.5 mm.

The dimple diameter is the diameter of a circle as viewed in a plane circumscribed by the dimple edge which is the uppermost position of the dimple merging with the land 5. The dimple depth is a radial distance from the plane to the deepest point or bottom of the dimple. The golf ball is finally painted as a general rule, and these sizes are defined in the painted state.

The total number of dimples on the golf ball is not critical although it is usually at least 300, especially 360 and up to 550, especially up to 500.

According to the invention, the dimples should include 330 to 400 large circular dimples having a diameter of at least 3.7 mm. If the number of large dimples having a diameter of at least 3.7 mm is less than 330, the ball may perform poorly in flight when hit with a driver and similar clubs intended for distance. If the number of large dimples having a diameter of at least 3.7 mm is more than 400, the flight performance may become inferior due to the interference between dimples.

A dimple defines a cavity between the plane circumscribed by the dimple edge and the dimple wall, and the dimple volume is the volume of this cavity. The total dimple volume given as the sum of the volumes of all dimples should be 330 to 380 $mm^3$. With a total dimple volume of less than 330 mmn, the ball will travel a too high trajectory when hit with a driver. With a total dimple volume of more than 380 $mm^3$, the trajectory may become too low. In both cases, the travel distance becomes short against the purpose of the invention.

The dimples may be arranged according to the conventional well-known arrangement method. Any of regular icosahedral, regular dodecahedral and other known arrangements may be used. The dimples should be substantially uniformly distributed on the ball (cover) surface such that there is no or only one great circle which does not intersect with the dimples. Then the dimples are distributed in a high density.

Figure 2:
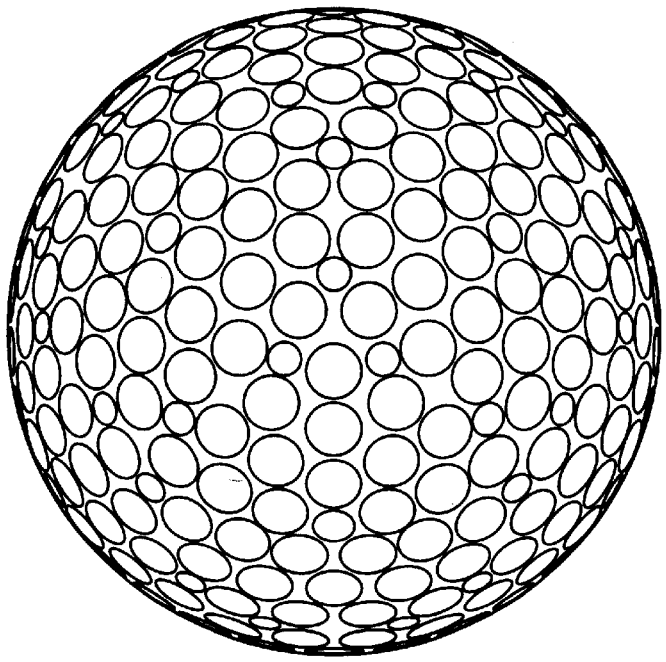
FIG. 2 is a perspective view illustrating a dimple arrangement on a golf ball according to the invention.

FIG. 2 illustrates one exemplary arrangement of dimples. In this embodiment, dimples of four types having a diameter of 3.9 mm, 3.8 mm, 2.9 mm and 2.5 mm are used in a number of 300, 60, 12 and 60, respectively, to a total number of 432, and arranged according to the spherical regular icosahedral arrangement. In the illustrated embodiment, a great circle which does not intersect with the dimples is absent on the spherical surface.

In the golf ball of the invention, dimples are distributed on the ball surface in a high density as described just above. Provided that the dimple area is the area of a planar circle circumscribed by the dimple edge, the total of dimple areas accounts for 78 to 85% of the spherical surface area of the ball which is assumed to be dimple-free. A percent dimple occupation within this range is effective for improving flight performance.

Provided that a sphere consisting of the core and the intermediate layer rested on a rigid plate undergoes a distortion A when the load applied thereto is increased from 98 N (10 kgf) to 1275 N (130 kgf), the intermediate layer has a Shore D hardness B, the cover has a Shore D hardness C and a gage D, and SP is defined as a function of A, B, C and D by the following equation:

$$SP=C+0.5B-5D+5A,$$

better results are obtained when SP is optimized. Specifically, it is recommended that SP be in the range of at least 80, especially at least 85 and up to 94, especially up to 92. Smaller values of SP may lead to a structure with more spin susceptibility whereas larger values of SP may lead to a structure with less spin susceptibility.

EXAMPLE

Examples of the invention are given below by way of illustration and not by way of limitation.

Examples 1–6 & Comparative Examples 1–4

Golf balls of a common three-piece solid structure consisting of a monolithic core of rubber, a single intermediate layer of ionomer resin and a single layer cover of thermoplastic polyurethane were prepared, aside from providing dimples of the parameters shown in Tables 1 and 2. A common arrangement of dimples as shown in FIG. 2 was used.

The golf balls were tested for flight performance. Using a hitting machine equipped with a driver (W#1), the ball was hit at a head speed (HS) of 50 m/s. Using high speed strobe photography, the spin rate and trajectory of the ball at the instant of impact were determined.

Different dimple arrangement sets including the type and number of dimples are shown in Table 1. The assignment of a dimple arrangement set to the ball, SP value, and the parameters used in computing SP are also shown in Table 1 together with the test results.

TABLE 1

| Arrangement set | Dimples Diameter (mm) | Depth (mm) | Number | Total number | Total volume ($mm^3$) | Area occupation (%) |
|---|---|---|---|---|---|---|
| W | 3.9 | 0.160 | 300 | 432 | 340 | 81.0 |
| | 3.8 | 0.160 | 60 | | | |
| | 2.9 | 0.140 | 12 | | | |
| | 2.5 | 0.110 | 60 | | | |
| X | 3.9 | 0.175 | 300 | 432 | 370 | 81.0 |
| | 3.8 | 0.170 | 60 | | | |
| | 2.9 | 0.160 | 12 | | | |
| | 2.5 | 0.115 | 60 | | | |
| Y | 3.9 | 0.145 | 300 | 432 | 310 | 81.0 |
| | 3.8 | 0.145 | 60 | | | |
| | 2.9 | 0.135 | 12 | | | |
| | 2.5 | 0.110 | 60 | | | |
| Z | 3.9 | 0.190 | 300 | 432 | 400 | 81.0 |
| | 3.8 | 0.185 | 60 | | | |
| | 2.9 | 0.165 | 12 | | | |
| | 2.5 | 0.115 | 60 | | | |

What is claimed is:

1. A golf ball comprising an elastic solid core, an intermediate layer around the core, and a resin cover around the intermediate layer, composed mainly of a urethane elastomer and having a plurality of dimples on its surface, wherein the dimples include 330 to 400 circular dimples having a diameter of at least 3.7 mm, and are substantially uniformly distributed such that there is no or only one great circle which does not intersect with the dimples, wherein the SP value is in the range of 80 to 94, provided that a sphere consisting of the core and the intermediate layer undergoes a distortion A when the load applied thereto is increased from 98 N (10 kgf) to 1275 N (130 kgf), the intermediate layer has a Shore D hardness B, the cover has a Shore D hardness C and a gage D, and SP is defined as a function of A, B, C and D by the following equation:

$$SP+\times C+0.5B-5D+5A,$$

and wherein the values of the parameters A, B, C and D are substantially as follows, the distortion A of the sphere consisting of the core and the intermediate layer the distortion A of the sphere consisting of the core and the intermediate layer is from 2.59 to 3.12 mm, the Shore D hardness B of the intermediate layer is from 55 to 68, the Shore D hardness C of the cover is from 45 to 56, and the gage D of the cover is 0.7 to 1.7 mm.

2. The golf ball of claim 1 wherein the dimples account for at least 78% of the outer surface area of the ball.

3. The golf ball of claim 1 wherein the hardness of the cover is lower than that of the intermediate layer and the difference in Shore D hardness between the intermediate layer and the cover is from 5 to 20 units.

TABLE 2

| | Example 1 | 2 | 3 | 4 | 5 | 6 | Comparative Example 1 | 2 | 3 | 4 |
|---|---|---|---|---|---|---|---|---|---|---|
| Dimple arrangement set | w | x | w | w | w | w | w | w | y | z |
| Number of dimples with diameter ≧ 3.7 mm | 360 | 360 | 360 | 360 | 360 | 360 | 360 | 360 | 360 | 360 |
| A: intermediate layer-core distortion (mm) | 2.89 | 2.98 | 2.74 | 2.86 | 2.59 | 3.12 | 2.54 | 3.25 | 2.89 | 2.89 |
| B: intermediate layer hardness (Shore D) | 63 | 61 | 63 | 66 | 63 | 61 | 58 | 66 | 63 | 63 |
| C: cover hardness (Shore D) | 47 | 47 | 50 | 50 | 53 | 53 | 45 | 53 | 47 | 47 |
| D: cover gage (mm) | 1.5 | 1.2 | 1.5 | 1.5 | 1.5 | 1.5 | 1.5 | 1.5 | 1.5 | 1.5 |
| Test results | | | | | | | | | | |
| SP | 85.5 | 86.4 | 87.7 | 89.8 | 90.0 | 91.6 | 79.2 | 94.8 | 85.5 | 85.5 |
| Spin rate (rpm) | 2737 | 2708 | 2669 | 2606 | 2602 | 2552 | 2924 | 2458 | 2720 | 2745 |
| Trajectory | somewhat high, but satisfactory | somewhat low, but satisfactory | satisfactory | satisfactory | satisfactory | satisfactory | rather skying | straight | too high | too low |

There have been described multi-piece solid golf balls which exhibit uniform flight performance.

Japanese Patent Application No. 2001-227864 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

4. The golf ball of claim 1 wherein the SP value is in the range of 85 to 92.

5. The golf ball of claim 4 wherein the core, the intermediate layer and the cover are formed of rubber composition using polybutadiene as the base rubber, ionomer resin and thermoplastic polyurethane, respectively.

6. The golf ball of claim 1 wherein the dimples have a total volume of 330 to 380 $mm^3$.

7. The golf ball of claim 1 wherein the diameter of the 330 to 400 circular dimples is up to 5.0 mm.

* * * * *